US007062183B2

(12) United States Patent
Maeyama et al.

(10) Patent No.: US 7,062,183 B2
(45) Date of Patent: Jun. 13, 2006

(54) RECORDING MEDIA IDENTIFIER AND RECORDING DEVICE

(75) Inventors: Ryuichiro Maeyama, Ebina (JP); Shigehito Ando, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 191 days.

(21) Appl. No.: 10/773,457

(22) Filed: Feb. 9, 2004

(65) Prior Publication Data

US 2005/0084275 A1 Apr. 21, 2005

(30) Foreign Application Priority Data

Mar. 13, 2003 (JP) ..... 2003-067537
Jan. 9, 2004 (JP) ..... 2004-004479

(51) Int. Cl.
*G03G 15/00* (2006.01)

(52) U.S. Cl. ..... 399/45; 347/19

(58) Field of Classification Search ..... 399/45, 399/9, 14, 15; 356/35
See application file for complete search history.

(56) References Cited

U.S. PATENT DOCUMENTS 4,720,808 A * 1/1988 Repsch ..... 702/175
5,650,851 A * 7/1997 Gagnon ..... 356/504
6,188,482 B1 * 2/2001 Cloud ..... 356/491
6,220,686 B1 * 4/2001 Ludi et al. ..... 347/4
6,804,477 B1 * 10/2004 Maruyama ..... 399/45
2003/0156150 A1 * 8/2003 Hayashi et al. ..... 347/19
2004/0246290 A1 * 12/2004 Hayashi et al. ..... 347/19

FOREIGN PATENT DOCUMENTS

EP 0 926 631 A2 * 6/1999
JP 2000-259044 A * 9/2000
WO WO 03/059631 A1 * 7/2003

OTHER PUBLICATIONS

"Media Identifier," Technical Information of Advanced Printers, HP, Japan, Nov. 27, 2000.

* cited by examiner

*Primary Examiner*—Sophia S. Chen
(74) *Attorney, Agent, or Firm*—Morgan, Lewis & Bockius, LLP

(57) ABSTRACT

The present invention provides a recording media identifier for identifying types of recording media, and a recording device, provided with a recording media identifier, which records images by printing on recording media. A speckle measuring section of the recording device measures a speckle on a recording medium conveyed on a conveyance path. Types of recording media are detected through correlation of the speckle measured with speckles stored in a storage section, in a manner in which the speckles correspond to types of recording media. Recording and fixing conditions of the recording device are adjusted according to the types of the recording media detected.

19 Claims, 11 Drawing Sheets

FIG. 6

| TYPE OF PAPER | CONTRAST VOLTAGE | PRIMARY TRANSFER CURRENT | FIXING SPEED |
|---|---|---|---|
| WOODFREE PAPER | 700V | 20μA | MAXIMUM |
| COATED CARDBOARD | 700V | 40μA | HALF SPEED |
| OHP | 500V | 35μA | HALF SPEED |

RECORDING MEDIA IDENTIFIER AND RECORDING DEVICE

CROSS-REFERENCE TO RELATED APPLICATION

This application claims priority under 35 USC 119 from Japanese Patent Application Nos. 2003-67537 and 2004-4479, the disclosures of which are incorporated by reference herein.

BACKGROUND OF THE INVENTION

1. Field of the Invention

The present invention relates to a recording media identifier and a recording device, and more particularly, relates to a recording media identifier for identifying types of recording media, and a recording device, provided with a recording media identifier, which records images by printing on recording media.

2. Description of the Related Art

Various types of recording media can be used for a recording device, which records images, by printing on recording media. However, if recording conditions for glossy paper are applied to papers of other types, e.g., plain paper, a problem of ink overflow occurs. Normally, before starting recording, a user is required to set the type of recording medium to be used on the recording device. The recording device thus records for the recording medium under optimum conditions corresponding to the type of recording medium.

In order to save a user the trouble of setting a type of recording medium, some recording devices also identify types of paper to be used for recording (See for example "Media identifier", technical information of advanced printers, HP Japan, Nov. 27, 2000, URL: http://review.ascii24.com/db/technical/printer/2000/11/27/619994-000.html). Such recording devices have a recording head provided with an optical sensor, adapted to determine paper reflectance, a wavelength of reflected light and the like so as to identify a type of paper. Such recording devices record by printing under optimum recording conditions corresponding to the type of paper identified. A database is disposed within such recording devices in which data can be stored, the paper reflectance, the wavelength of reflected light and the like of various types of paper (e.g., inkjet recording paper, plain paper, woodfree paper produced by various companies), and this data can be used for identifying a considerable variety of types of paper.

However, common problem in conventional recording devices is mistaken identification of paper, i.e., that different types of paper having similar reflectance and wavelength of reflectance (i.e., having the same kind of glossiness on the surface of the paper,) are deemed by the devices to be identical. Further, when a conventional recording device is used, recording media other than paper, such as transparent films for OHP (overhead projectors), cannot be identified.

SUMMARY OF THE INVENTION

The present invention was developed in light of the aforementioned, and an object thereof is to provide a recording media identifier for identifying types of recording media, and a recording device, provided with a recording media identifier, which records images by printing on recording media.

In order to achieve the above object, a first aspect of the present invention is a recording media identifier comprising: a measuring component, which irradiates a recording medium with a predetermined light to measure a speckle, caused by light irradiation, appearing on the recording medium; a storage component, which stores information on speckles of recording media; and an identifying component, which identifies types of recording media on the basis of the speckle measured by the measuring component and on the basis of information on speckles stored in the storage component.

Thus, the measuring component irradiates the recording medium with a predetermined light to measure a speckle, caused by light irradiation, appearing on the recording medium. The storage component stores information on speckles of recording media. The identifying component identifies the type of recording medium on the basis of the speckle measured by the measuring component, and on the basis of the information on speckles stored in the storage component. With this structure, different recording media having the same kind of glossiness at surfaces thereof can be distinguished, and recording media other than paper, including transparent films for OHP, can also be identified.

The measuring component of the recording media identifier of the first aspect may identify types of recording media on the basis of speckle patterns.

The identifying component of the recording media identifier of the first aspect may identify types of recording media based on vectors representing movements in speckles.

The vectors of the first aspect representing movements in speckles may be obtained through cross-correlation.

The measuring component of the recording media identifier of the first aspect may measure the speckle in each of a plurality of different measuring conditions.

In this case, the plurality of measuring conditions may differ in accordance with positions of the recording medium at times of measurement. More particularly, the measuring component may move the recording medium in such a way that the recording medium can be measured at different positions. The measuring component may move the recording medium by causing the recording medium to vibrate. The vibration of the recording medium may be achieved, for example, by using a motor or the like to cause a housing component containing the recording medium to vibrate.

The identifying component of the recording media identifier of the first aspect may identify each of a plurality of recording media of the same type.

In the recording media identifier of the first aspect, the recording medium, when irradiated with a predetermined light, may scatter light, which includes a speckle. The measuring component may include: an irradiating component, which irradiates a predetermined light; a plurality of light-receiving components arranged in a predetermined direction in a mutually spaced manner, which receives the light caused by predetermined light irradiation scattered from the recording medium, and outputs signals having an intensity corresponding to the luminous intensity of the scattered light received by the light-receiving components; and a signal processing component, which binarizes the signals outputted from each of the plurality of light-receiving components and outputs binary signals.

Thus, the irradiating component irradiates a predetermined light. The plurality of light-receiving components are arranged in a predetermined direction in a mutually spaced manner. The predetermined direction is preferably a direction in which the recording medium is conveyed.

When irradiated with a predetermined light, the recording medium scatters light, which includes a speckle. The plurality of light-receiving components receives the light caused by light irradiation scattered from the recording medium, and outputs signals having an intensity corresponding to the luminous intensity of the scattered light received by the light-receiving components. Thus, when the irradiating component irradiates the surface with a predetermined light, the surface scatters light, which includes the speckle, and the light, which includes the speckle, is received by the light-receiving components.

The signal processing component binarizes signals outputted from each of the plurality of light-receiving components and outputs binary signals.

Here, when the recording medium is conveyed while being irradiated with a predetermined light from the irradiating component, the speckle included in the light to be received by the light-receiving components moves within the area in which the light is received by the light-receiving components. Thus, the intensity of the speckle is reflected in the signals outputted from the light-receiving components.

As stated hereinabove, the plurality of light-receiving components, which receives the light scattered from the surface to be irradiated, i.e., which receives the speckle, is arranged in a predetermined direction in a mutually spaced manner as stated hereinabove. Thus, the signals outputted from each of the plurality of light-receiving components have the same waveform but are outputted in different phases. Similarly, the binary signals, binarized and outputted from the signal processing component, which signals have been outputted from each of the plurality of light-receiving components, have the same waveform but are outputted in different phases. This difference in phases, which in other word is a difference in timing at the same portion of the signals outputted from each of the plurality of light-receiving components, corresponds to the velocity at which the recording medium is conveyed. Thus, the velocity and direction of conveyance of the recording medium can be measured by a specific arrangement of the light-receiving components. Consequently, at least one vector (relating to at least one of direction and size) representing movements in the speckle can be identified.

A recording device of a second aspect of the present invention comprises the recording media identifier of the first aspect and a recording component, which records an image on a recording medium by printing.

Thus, the recording device comprises the recording media identifier of the first aspect and the recording component, which records an image on a recording medium by printing. With this structure, different recording media having the same kind of glossiness at surfaces thereof, and recording media other than paper, including transparent films, can be distinguished.

The recording component of the recording device of the second aspect may adjust recording conditions to correspond to types of recording media identified by the recording media identifier.

The recording device of the second aspect may further comprise a fixing component which fixes, onto the recording medium, an image recorded by the recording component, and the measuring component may measure the speckle before fixing of the recorded image onto the recording medium is carried out by the fixing component.

The fixing component of the recording device of the second aspect may adjust fixing conditions to correspond to types of recording media identified by the recording media identifier.

The recording device of the second aspect may further comprise a fixing component which fixes, onto the recording medium, an image recorded by the recording component, and the measuring component may measure the speckle after fixing of the recorded image onto the recording medium has been carried out by the fixing component.

The recording component of the recording device of the second aspect may further comprise a conveyor component, which conveys the recording media, and the measuring component may measure the speckle when the recording medium is not being conveyed by the conveyor component.

The recording component of the recording device of the second aspect may further comprise a conveyor component, which conveys the recording media, and the measuring component may measure the speckle while the recording medium is being conveyed by the conveyor component.

The recording medium is moved by the conveyor component.

As explained hereinabove, the measuring component of the recording device of the present invention irradiates the recording medium with a predetermined light while the recording medium is being conveyed, and measures the speckle caused by light irradiation appearing on the recording medium. The storage component stores information on speckles of recording media. The identifying component identifies types of recording media on the basis of speckles measured by the measuring component and on the basis of the information on speckles stored in the storage component. With this structure, different recording media having the same kind of glossiness at surfaces thereof, and recording media other than paper, including transparent films, can be distinguished.

BRIEF DESCRIPTION OF THE DRAWINGS

FIG. 6 is a table showing an example of relationships between types of recording media, recording conditions and fixing conditions.

DETAILED DESCRIPTION OF THE INVENTION

Figure 1:
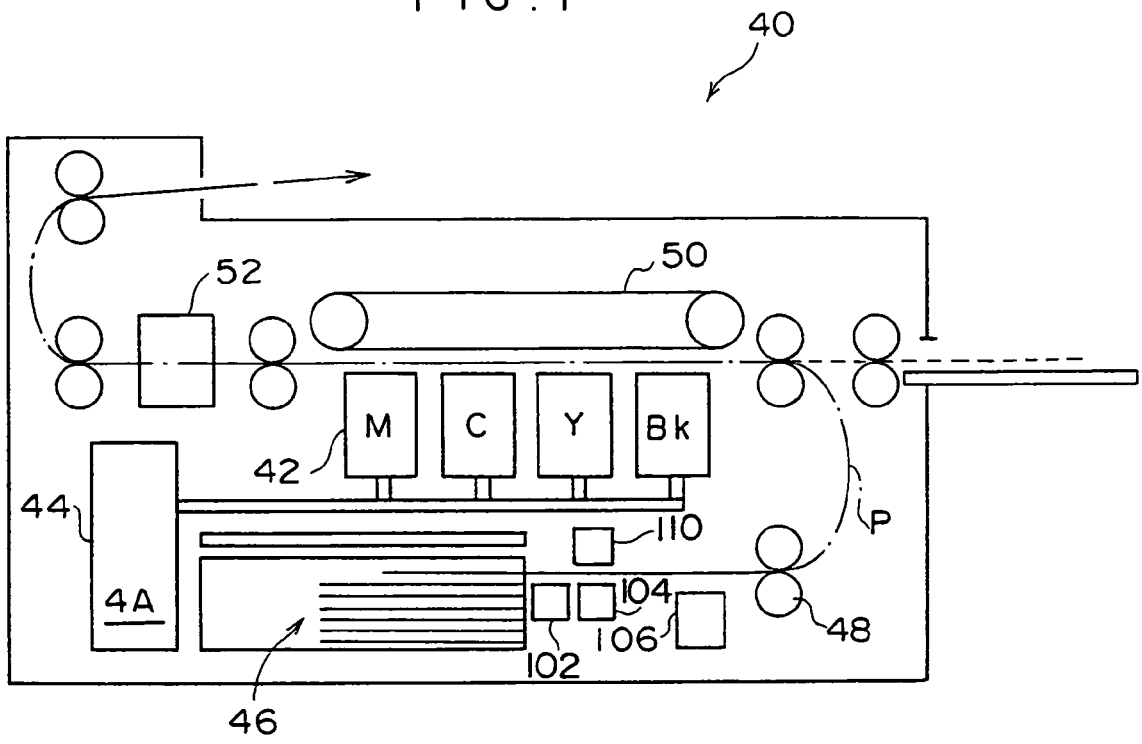
FIG. 1 is a block diagram showing a recording device of an embodiment of the present invention.

Referring to the drawings, an embodiment of the present invention will be described hereinbelow.

As shown in FIG. 1, a recording device 40 relating to the present embodiment has the following: a storage section 44, which stores liquid ink 4A; four recording heads 42 to which magenta(M), cyan(C), yellow(Y) and black(Bk) liquid inks 4A are respectively supplied from the storage section 44; a recording medium tray 46, which contains recording media; conveyor sections 48 and 50 which convey a recording medium from the recording medium tray 46 along a conveyance path P; a fixing section 52, which fixes an image onto the recording medium after the image has been recorded by liquid inks ejected from the recording heads 42; an optical sensor 102, which detects the recording medium; a recording medium vibrating section 110, which makes the recording media vibrate; a vibration sensor 104, which detects vibrations of the recording media; and a speckle measuring section 106, which measures speckles on the recording media.

The fixing section 52 includes a nip section consisting of, but is not limited to, pressure rollers and heat rollers. The fixing section 52 fixes a recorded image onto the recording medium by heating and pressing the recording medium while conveying the same through the nip section. Alternatively, the fixing section 52 may include a nip section consisting of a heating pad and a film-like member.

Figure 2:
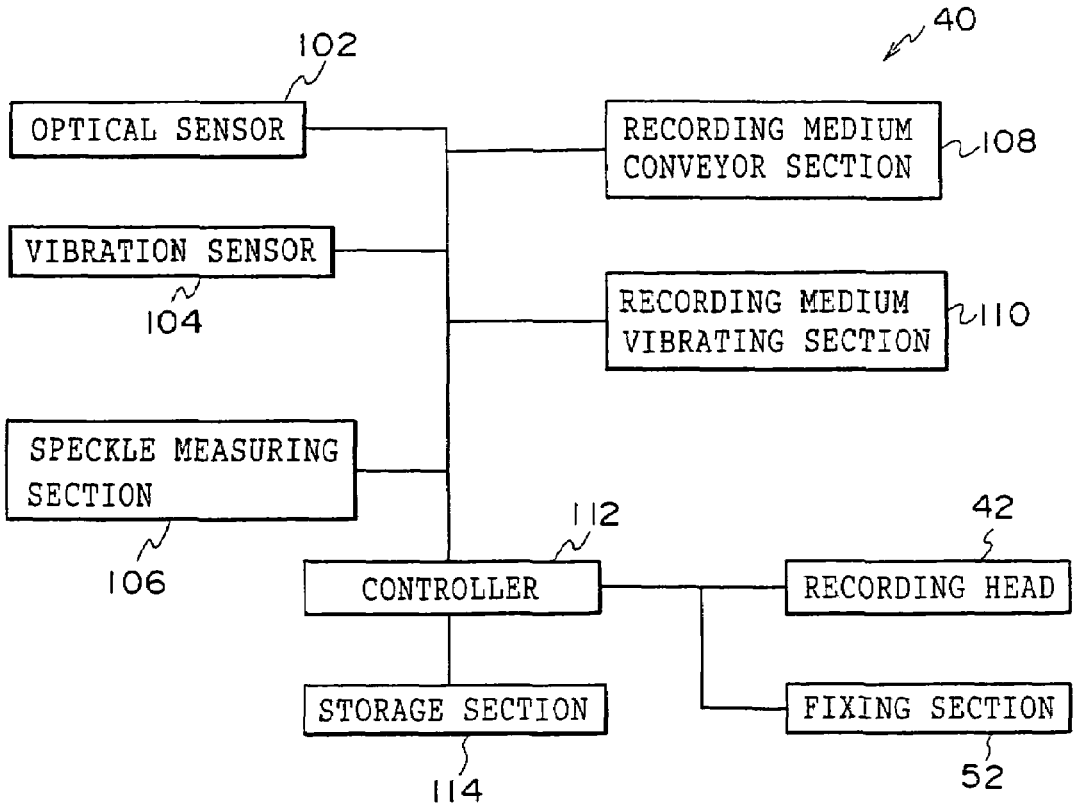
FIG. 2 is a functional block diagram showing the recording device of the embodiment.
Figure 10:
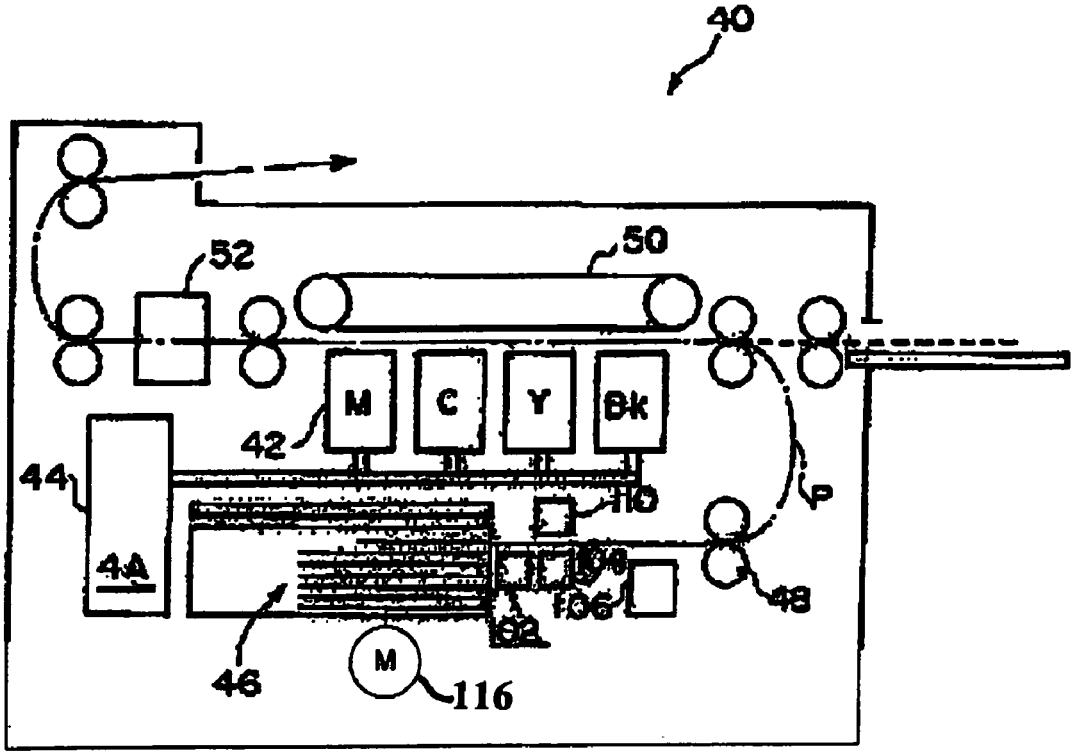
FIG. 10 is a block diagram showing a recording device of an embodiment of the present invention.

FIG. 2 is a functional block diagram of the recording device 40 shown in FIG. 1. As also shown in FIG. 1, the recording device 40 includes: the optical sensor 102, which detects the recording medium; the vibration sensor 104, which detects vibration of the recording medium; the speckle measuring section 106, serving as a measuring component, which measures speckles on recording media; a recording medium conveyor section 108, serving as a conveyor component, corresponding to conveyor sections 48 and 50; the recording medium vibrating section 110, serving as a vibrating component, which makes the recording medium vibrate; recording heads 42, which record an image on the recording medium; and the fixing section 52, which fixes recorded images. FIG. 2 shows that the recording device 40 further comprises a storage section 114, serving as a storage component, which stores information on speckles on recording media, corresponding to types of recording media, and a controller 112, serving as an identifying component, which controls each section. The recording medium vibrating section 110 can be, but is not limited to, a small motor 116, which makes the recording medium vibrate through vibration of the recording, medium tray 46 (See FIG. 10). A piezoelectric element or acoustical element may also be used as the recording medium vibrating section 110.

The speckle measuring section 106 serving as the measuring component, the storage section 114 serving as the storage component, and the controller 112 serving as the identifying component, combined constitute the recording media identifier. The recording heads 42 and the controller 112 constitute the recording component. The fixing section 52 and the controller 112 constitute the fixing component.

Figure 3:
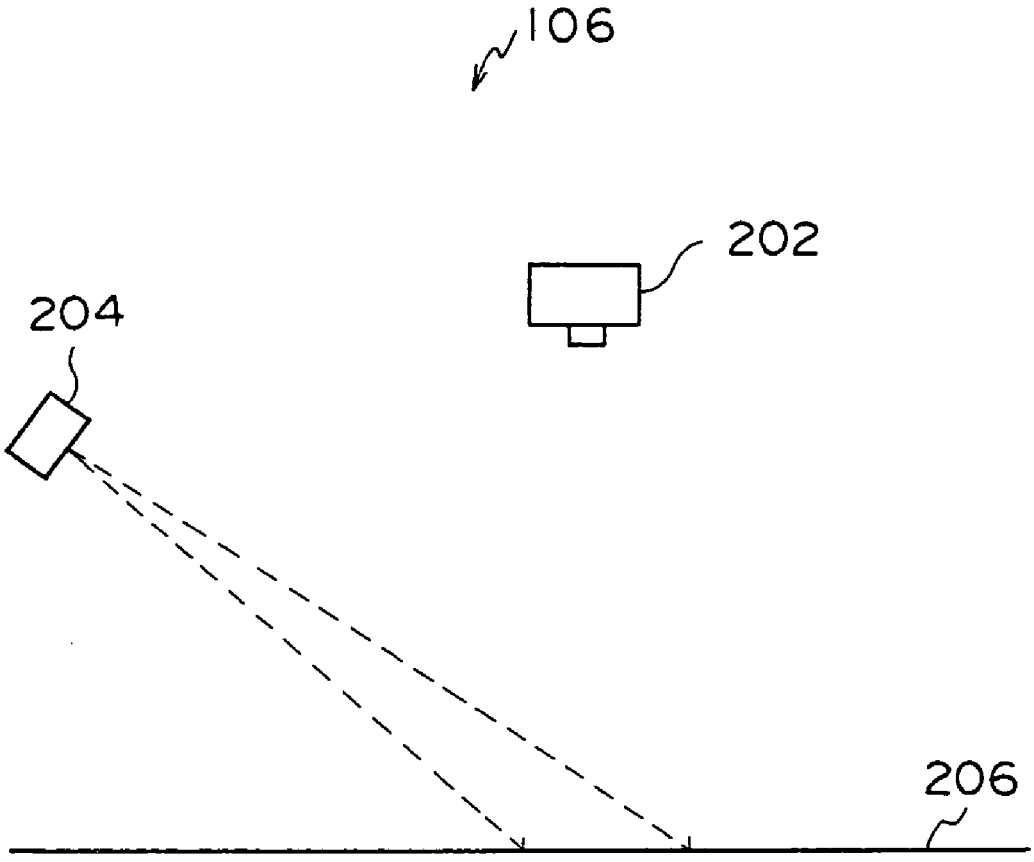
FIG. 3 is a block diagram showing a speckle measuring section of the embodiment.

As shown in FIG. 3, the speckle measuring section 106 includes a light source 204 which irradiates a recording medium 206 with a predetermined light such as a laser, and an image pick-up element 202, such as a CCD, which picks up a speckle image appearing on the recording medium 206 at a point irradiated by the light source 204. A speckle is a spot-like pattern with a high contrast appearing on a recording medium when the recording medium is irradiated with highly coherent light such as a laser (See FIG. 5.). Recording media of different types have different speckles. Thus, different speckles appear on different recording media, even when they have the same kind of surface glossiness. Further, unique speckles appear on recording media other than paper, including transparent films for OHP, corresponding to the types of recording media. Consequently, a type of recording medium can be detected by measuring speckles.

Figure 11:
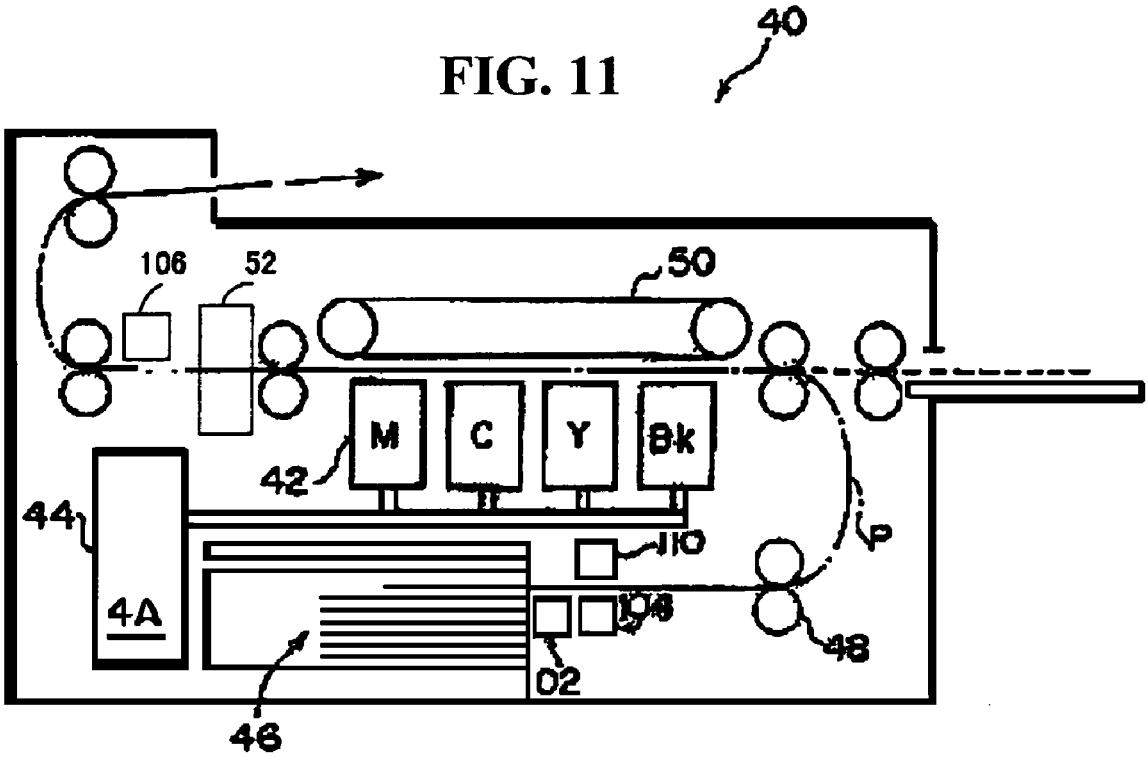
FIG. 11 is a block diagram showing a recording device of an embodiment of the present invention.

Moreover, as shown in FIG. 11, the speckle measuring section 106 serving as the measuring component may be located after the fixing section 52, wherein the measuring component measures the speckle after fixing of the recorded image onto the recording medium has been carried out by the fixing component.

Next, an operation of the present embodiment will be described hereinbelow, with reference to FIG. 4.

Figure 4:
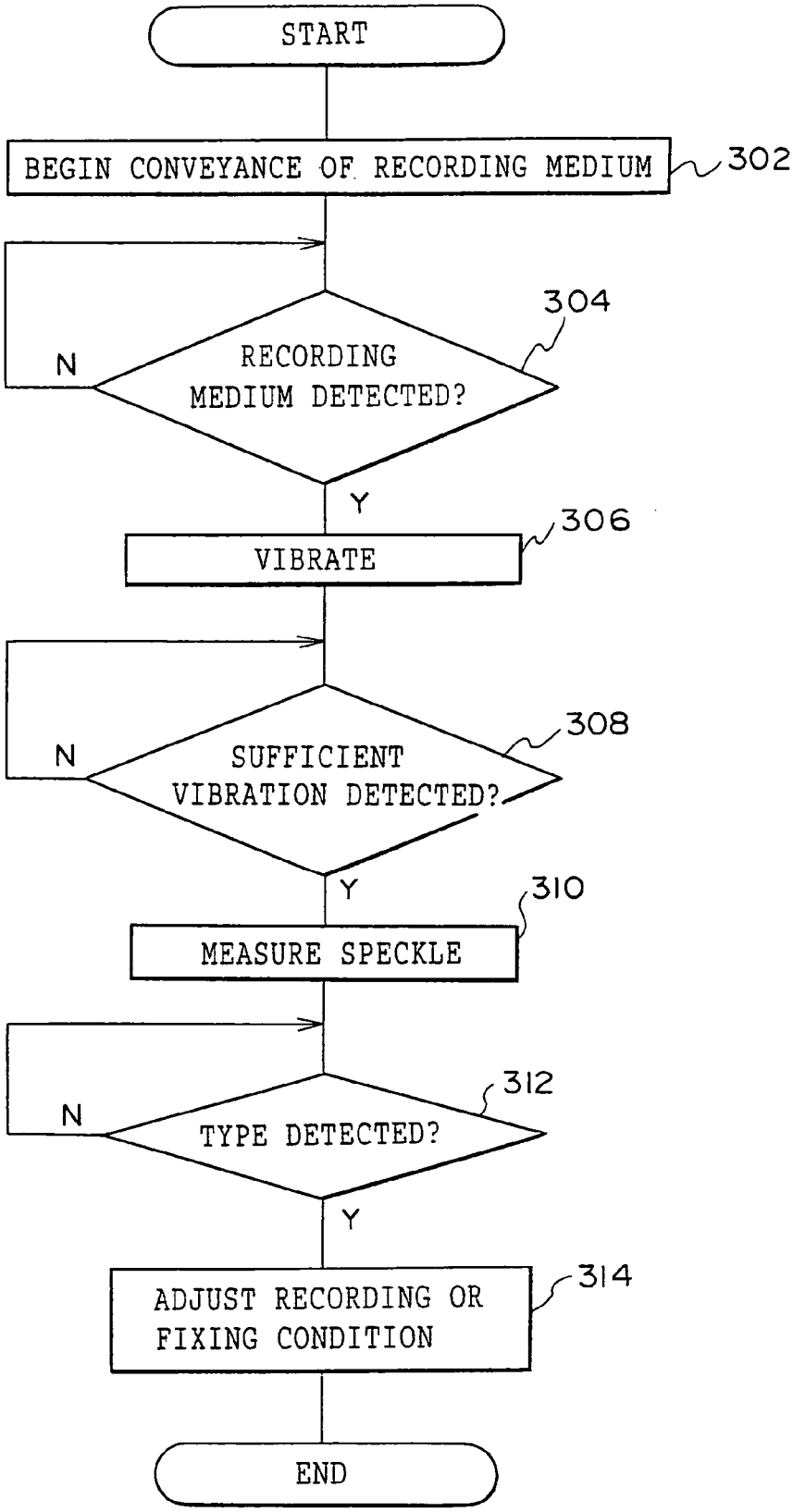
FIG. 4 is a flow chart showing an operation of the embodiment.

A routine shown in FIG. 4 begins with a user giving instructions to start recording of an image on the recording medium 206 from, for example, a personal computer connected to the recording device 40. In step 302, the recording medium conveyor section 108 of the recording device 40 begins conveyance of the recording medium 206, which travels from the recording medium tray 46 along a conveyance path P.

In step 304, the optical sensor 102 detects the recording medium 206 at a given position on the conveyance path P where the optical sensor 102 is disposed. Step 304 is repeated until the optical sensor 102 detects the recording medium 206. When the recording medium 206 has been detected in step 306, the recording medium vibrating section 110 makes the recording medium 206 vibrate. In this way, the optical sensor 102, the recording medium vibrating section 110 and the vibration sensor 104 are disposed upstream in the speckle measuring section 106 along the conveyance path P. Here, the recording medium 206 is detected and then made to vibrate to an extent necessary to prepare for measurement of the speckle.

In step 308, the vibration sensor 104 detects vibration of the recording medium 206. Step 308 is repeated until the vibration sensor 104 detects a degree of vibration sufficient for the speckle to be measured. The vibration sensor 104 may transmit to the recording medium vibrating section 110 signals that it has detected representing vibration of the recording medium 206, thereby controlling vibration generated by the recording medium vibrating section 110. While a speckle exhibits a unique pattern even without the benefit of vibration, that the unique pattern becomes even more distinct when the recording medium 206 is made to vibrate.

Figure 5:
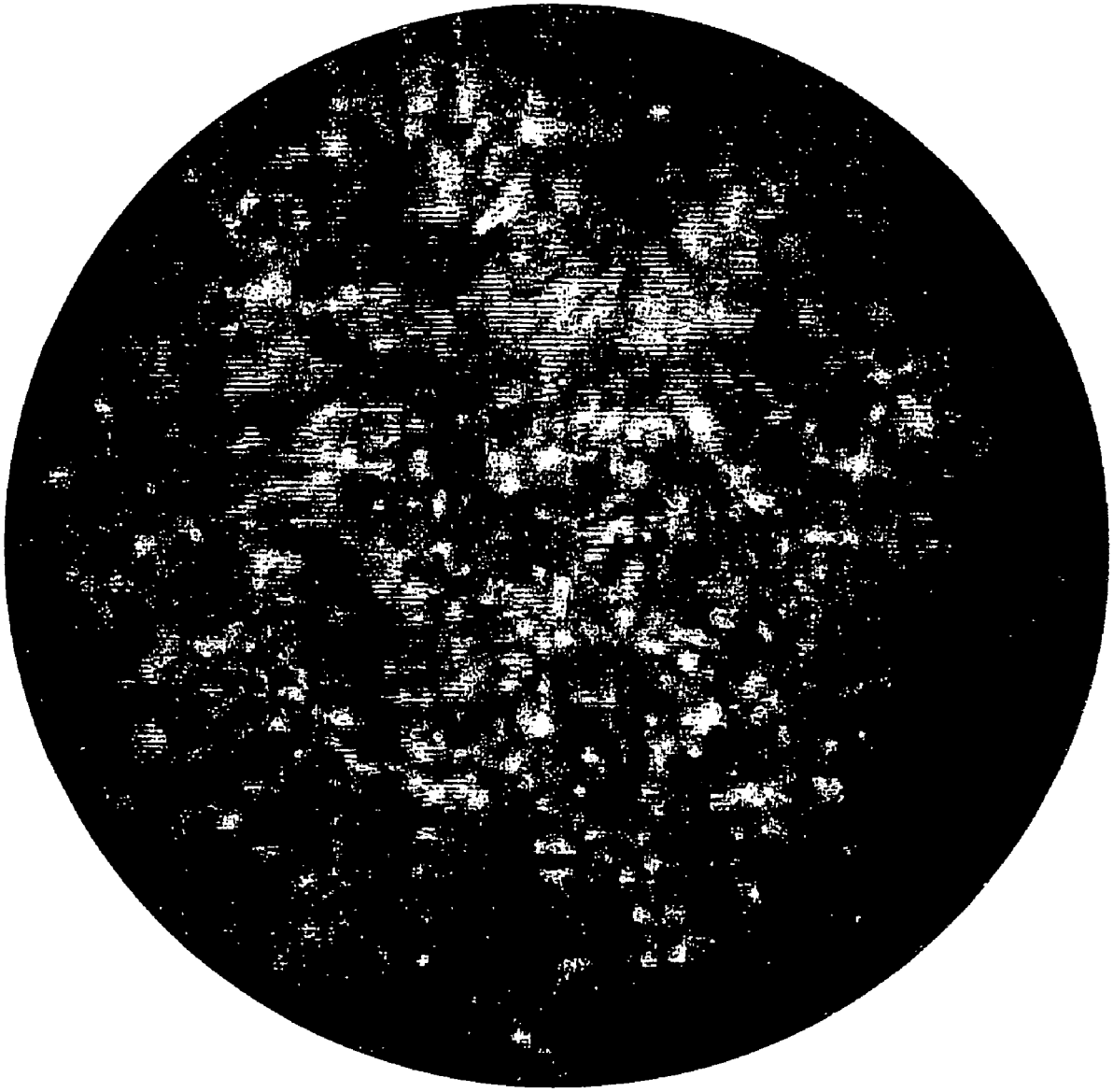
FIG. 5 is a view illustrating an example of a speckle on a recording medium.

In step 310, the speckle measuring section 106 measures the speckle on the recording medium 206. In particular, the pick-up element 202 picks up a surface of the recording medium 206 while the surface is being irradiated by the light source 204 with a light such as a laser. An example of speckle patterns that have been picked up is shown in FIG. 5.

In step 312, the controller 112 seeks to detect the type of recording medium 206, a process which is repeated until the type of recording medium 206 has been detected. In particular, information concerning speckles concerning recording media, corresponding to different types of recording media, is stored in advance in the storage section 114. A speckle measured in step 310 is compared with speckles stored in the storage section 114. A type of recording medium corresponding to the appropriate speckle in the storage section 114 is determined to be the type of recording medium 206.

When the type of the recording medium 206 has been detected in step 314, the controller 112 adjusts image recording conditions at the recording heads 42 and fixing conditions for recorded images at the fixing section 52, thus bringing the process to conclusion. For example, a table as shown in FIG. 6, showing relationships between types of recording media, recording conditions and fixing conditions, may be stored in the storage section in advance. Then, recording conditions and fixing conditions correspnoding to the types of recording media 206 can be are adjusted by reading out from the table recording and fixing conditions corresponding to the type of recording media 206 detected in step 312.

When, for example, it is determined that the recording medium 206 is a coated cardboard, the recording conditions can be adjusted, but are not so limited, in such a way that, an amount of liquid ink ejected from the recording heads 42 is small, and the fixing conditions can be adjusted, but are not so limited, in such a way that, a conveyance speed of the recording medium is reduced to half speed and a fixing temperature is set at a low level.

Figure 7:
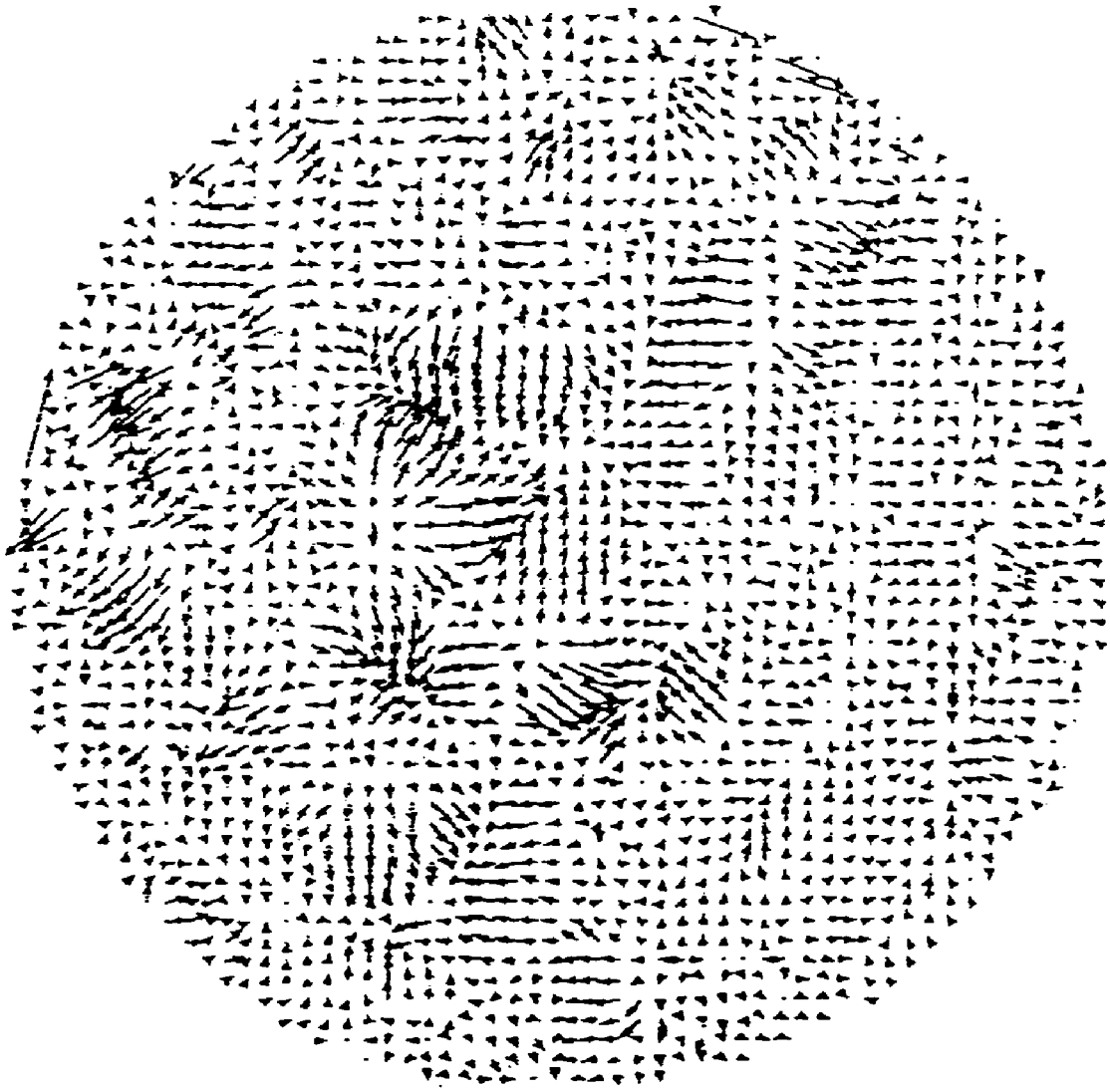
FIG. 7 is a view illustrating an example of a vector pattern representing movements in a speckle on a recording medium.

While in step 312 the type of recording medium 206 was detected through correlation between the speckle captured and the speckles of recording media already stored previously in the storage section 114, the present invention is not limited thereto. Alternatively, vector patterns, as shown in FIG. 7, obtained through cross-correlation or the like, representing movements in speckles picked up over minute intervals of time may be stored in advance in the storage section 114, corresponding to types of recording media. In this case, in step 310, the speckle of a recording medium 206 is picked up over minute intervals of time, and a vector pattern representing movement in the speckle is obtained. Then the vector pattern thus obtained and the vector patterns already stored in the storage section 114 are correlated to determine the type of the recording medium 206. In addition, each of a plurality of recording media of the same type may be identified (i.e., distinguished) on the basis of vector patterns of speckles.

The speckle pattern measured in step 310 and the speckle patterns previously stored in the storage section 114 may optionally be subjected to image processing as a preparation for facilitating pattern-matching. Speckles may also be measured by a photoelectric transfer element, which receives light reflected by a speckle appearing on a surface of a recording medium 206 and then converts the light to electric signals, rather than being picked up by the pick-up element 202 as an image. In the present embodiment, the recording medium vibrating section 110 is provided to make the recording medium 206 vibrate to allow for measurement of the speckle, but the present invention is not limited to the same. Alternatively, for example, in a case where speckles are satisfactorily measured with merely an operation to make the recording device 40 vibrate, there is no need to provide a recording medium vibrating section 110.

As described hereinabove, in the present embodiment, the light source 204 of the speckle measuring section 106 irradiates the recording medium 206 with a laser while the recording medium 206 is vibrating, so as to measure a speckle caused by laser irradiation appearing on the recording medium 206. The storage section 114 stores information on speckles of recording media. The controller 112 is provided to identify types of recording media 206 on the basis of speckles measured by the speckle measuring section 106 and on the basis of information on speckles stored in the storage section 114.

Thus, the measuring component irradiates the recording medium with a predetermined light while the recording medium is vibrating, thus measuring a speckle, caused by light irradiation, appearing on the recording medium. The storage component stores information on speckles of recording media. The identifying component identifies types of recording media on the basis of the speckles measured by the measuring component and on the basis of the information on speckles stored in the storage component. With this structure, different recording media having the same kind of glossiness at surfaces thereof, and recording media other than paper, including transparent films, can be distinguished.

The light irradiated on the recording medium 206 from the light source 204 for causing speckles to appear is not limited to a laser, and alternatively appropriate lights can be used. Although the recording device 40 is employed in the present embodiment as described hereinabove, the present invention is not limited thereto and any other recording media identifier devoid of the recording heads 42 and the fixing section 52 can be used appropriately adapted to identify types of recording media.

In the present embodiment, the recording device 40 or the recording media identifier comprises a recording medium vibrating section 110 as a vibrating component. Accordingly, with the recording medium vibrating section 110, the recording medium 206 can be made to vibrate to a sufficient degree to ensure appropriate measurement of a speckle even when an operation to make the recording device 40 or the recording media identifier vibrate is inadequate for purposes of measuring the speckle. With this structure, accuracy in detecting types of recording media can be enhanced.

As stated hereinabove, the recording device 40 further comprises recording heads 42 which record an image by printing on the recording medium 206.

Thus, the measuring component irradiates the recording medium with a predetermined light while the recording medium is vibrating, and measures a speckle caused by light irradiation appearing on the recording medium. The storage component stores information on speckles of recording media. The identifying component identifies types of recording media on the basis of speckles measured by the measuring component and on the basis of information on speckles stored in the storage component. The recording component records an image by printing on a recording medium. With this structure, different recording media having the same kind of glossiness at surfaces thereof, and recording media other than paper, including transparent films, can be distinguished.

While in the present embodiment, the recording heads 42 of the recording device 40 record an image on a recording medium by ejecting ink onto the recording medium the recording component of the present invention is not limited to such inkjet recording heads.

As stated hereinabove, the recording device 40 further comprises a fixing section 52 which fixes, onto the recording medium 206, an image recorded by the recording heads 42. The speckle measuring section 106 may measure the speckle before fixing of the recorded image onto the recording medium 206 is carried out by the fixing section 52. Rather than being limited to the position shown in FIG. 1, the speckle measuring section 106 can be disposed at any upstream position in the fixing section 52 along the conveyance path P. The optical sensor 102 which detects the recording medium 206, the vibration sensor 104 which detects vibration of the recording medium 206, and the recording medium vibrating section 110 which makes the recording medium 206 vibrate are disposed at any appropriate upstream positions in the speckle measuring section 106.

The controller 112 and the fixing section 52 adjust fixing conditions for images recorded on the recording medium 206 according to types of the recording media 206 detected.

Fixing that conforms to the type of recording medium improves the quality of images recorded on recording media.

The speckle measuring section 106 can also be disposed downstream in the fixing section 52 along the conveyance path P. The optical sensor 102 which detects the existence of the recording medium 206, the vibration sensor which detects vibration of the recording medium 206, and the recording medium vibrating section 110 which makes the recording medium 206 vibrate are all disposed in any appropriate upstream positions in the speckle measuring section 106.

To enable speckle on a recording medium 206 to be measured by the speckle measuring section 106, the recording medium conveyor section 108 may be halted so that the speckle can be measured while the recording medium 206 is stationary. Alternatively, the speckle may be measured while the recording medium 206 is moving, thus obviating the need to halt the recording medium conveyor section 108.

Figure 8:
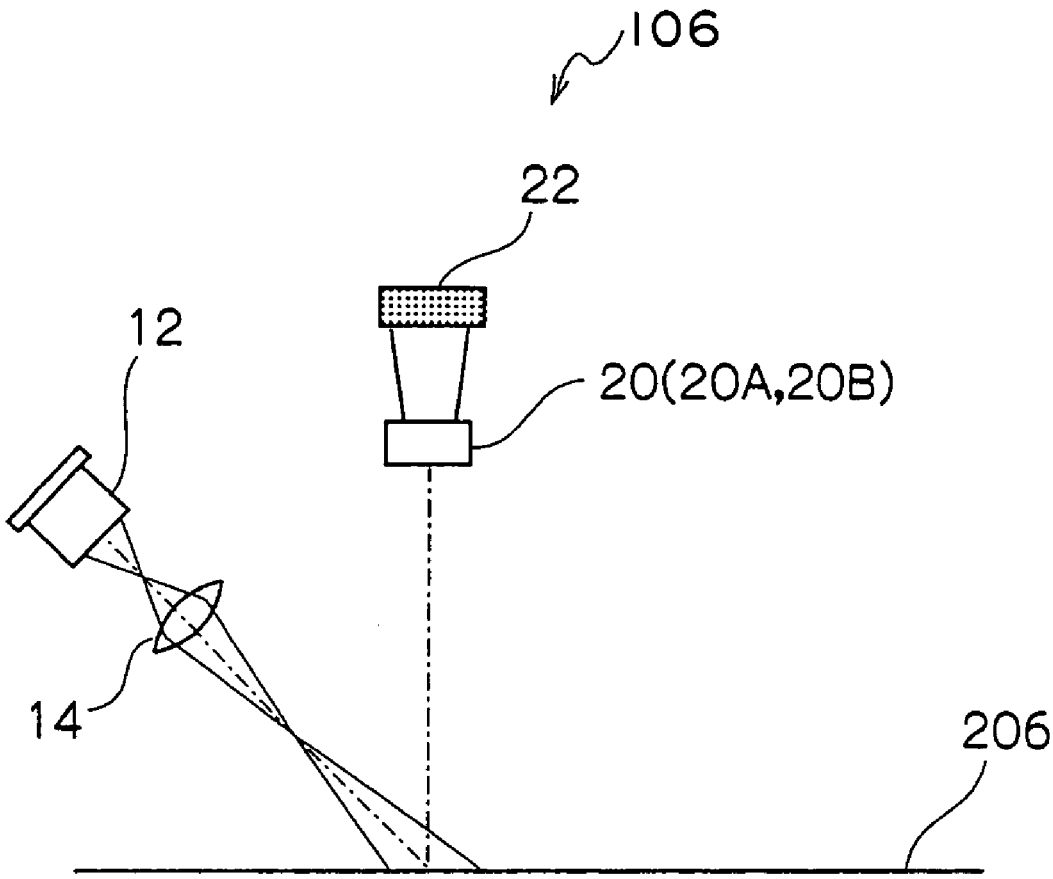
FIG. 8 is a schematic block diagram showing a speckle measuring section.

Next, the speckle measuring section 106 will be described in detail. As shown in FIG. 8, the speckle measuring section 106 relating to the present embodiment comprises: serving as an irradiating component, a semiconductor laser 12 (corresponding to the light source 204 in FIG. 3), which irradiates a recording medium with a highly coherent light such as a laser; a lens 14 which converts the laser beam irradiated from the semiconductor laser 12 into a desired Gaussian beam; serving as light-receiving components, a plurality of photodiodes 20 (20A and 20B, corresponding to the pick-up element 202) arranged in a predetermined direction in a mutually spaced manner, which first receives the light scattered from the recording medium 206, which itself, when irradiated with a laser beam, scatters light that includes a speckle, and which plurality of photodiodes 20 then outputs signals having an intensity corresponding to the luminous intensity of the scattered light received by the photodiodes 20; and a detecting circuit 22, serving as a signal processing component, which binarizes the signals outputted from each of the plurality of photodiodes 20 (20A, 20B) and outputs binary signals.

By way of example only, and not by way of limitation, the predetermined direction in the present embodiment is parallel to the direction in which the recording medium 206 is conveyed (moved). In other words, the predetermined direction is parallel to the surface of the drawing of FIG. 8. The predetermined direction may also intersect the direction in which the recording medium 206 is conveyed.

Figure 9:
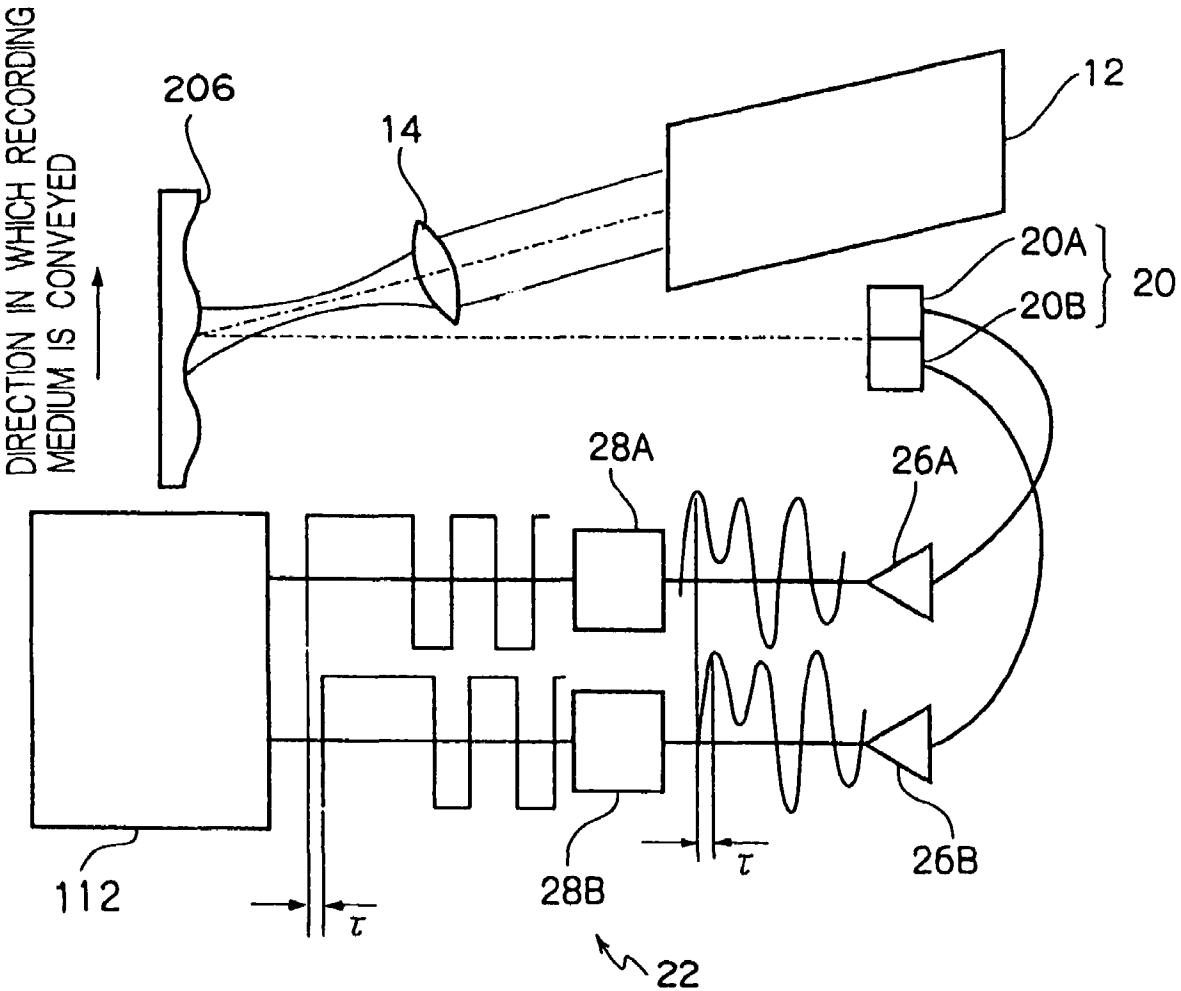
FIG. 9 is a block diagram showing a speckle measuring section.

As shown in FIG. 9, the detecting circuit 22 comprises: amplifiers 26A and 26B, connected respectively to the photodiodes 20A and 20B, and which amplify the signals transmitted from the photodiodes 20A and 20B; and binarizing circuits 28A and 28B, connected respectively to the amplifiers 26A and 26B, and which binarize the amplified signals transmitted from the photodiodes 20A and 20B by means of a threshold of value procedure. Output terminals of the binarizing circuits 28A and 28B are connected to the controller 112.

Operation of the speckle measuring section 106 of the present embodiment will be described hereinbelow.

The semiconductor laser 12 irradiates a laser beam, which is converted into a desired Gaussian beam by the lens 14.

When irradiated with the laser beam, the recording medium 206 scatters light, which includes a speckle. The light scattered from the recording medium 206 is received by the photodiodes 20A and 20B, which then output signals having an intensity corresponding to the luminous intensity of the scattered light.

The signals outputted from each of the photodiodes 20 (20A and 20B) are input into the detecting circuit 22, where the signals are binarized and outputted as binary signals.

As described hereinabove, the photodiodes 20A and 20B, which receive the light scattered from the irradiated surface, are disposed in a mutually spaced manner in the direction in which the recording medium 206 is conveyed. The signals outputted from each of the photodiodes 20A and 20B have similar waveforms but are outputted in different phases. Similarly, the binary signals, which have been outputted from the photodiodes 20A and 20B and subjected to binarization by the signal processing component, have the same waveform but are outputted in different phases. This difference in phases, which in other words is a difference in timing $\tau$ at the same portion of the signals outputted from each of the photodiodes 20A and 20B, corresponds to the velocity at which the recording medium is conveyed. Thus, the velocity and direction of conveyance of the recording medium can be measured by specific arrangements of the photodiodes 20A and 20B.

What is claimed is:

1. A recording media identifier comprising:

a measuring component, which irradiates a recording medium with a predetermined light to measure a speckle, caused by light irradiation, appearing on the recording medium which is made to vibrate;

a storage component, which stores information on speckles of recording media; and an identifying component, which identifies types of recording media on the basis of the speckles measured by the measuring component and of information on speckles stored in the storage component.

2. The recording media identifier according to claim 1, wherein the identifying component identifies types of recording media based on speckle patterns.

3. The recording media identifier according to claim 1, wherein the identifying component identifies types of recording media on the basis of vectors representing movements in speckles.

4. The recording media identifier according to claim 3, wherein the vectors representing movements in speckles are obtained through cross-correlation.

5. The recording media identifier according to claim 1, wherein the measuring component measures the speckle in each of a plurality of different measuring conditions.

6. The recording media identifier according to claim 5, wherein the plurality of measuring conditions differs in accordance with positions of the recording medium at times of measurement.

7. The recording media identifier according to claim 6, wherein the measuring component measures the recording medium at different positions as the recording medium vibrates.

8. The recording media identifier according to claim 1, wherein the measuring component makes the recording medium vibrate by making a housing component containing the recording medium vibrate.

9. The recording media identifier according to claim 8, wherein the measuring component uses a motor to make the housing component vibrate.

10. The recording media identifier according to claim 1, wherein the identifying component identifies each of a plurality of recording media of the same type.

11. The recording media identifier according to claim 1, wherein:

the recording medium, when irradiated with a predetermined light, scatters light which includes a speckle; and the measuring component includes:

an irradiating component, which irradiates a predetermined light;

a plurality of light-receiving components arranged in a predetermined direction in a mutually spaced manner, which receives the light, caused by predetermined light irradiation, scattered from the recording medium, and outputs signals having an intensity corresponding to the luminous intensity of the scattered light received by the light-receiving components; and a signal processing component, which binarizes the signals outputted from each of the plurality of light-receiving components and outputs binary signals.

12. The recording media identifier according to claim 11, wherein a direction, in which a center of an area in which light is received by each of the plurality of the light-receiving components travels on the recording medium, corresponds with a direction in which the recording medium is conveyed.

13. A recording device comprising:

(a) a recording media identifier, including a measuring component, which irradiates a recording medium with a predetermined light to measure a speckle, caused by light irradiation, appearing on the recording medium which is made to vibrate, a storage component, which stores information on speckles of recording media, and an identifying component, which identifies types of recording media on the basis of the speckles measured by the measuring component and of information on speckles stored in the storage component; and (b) a recording component, which records an image on a recording medium by printing.

14. The recording device according to claim 13, wherein the recording component adjusts recording conditions to correspond to types of recording media identified by the recording media identifier.

15. The recording device according to claim 13, further comprising a fixing component which fixes, onto the recording medium, an image recorded by the recording component, wherein the measuring component measures the speckle before fixing of the recorded image onto the recording medium is carried out by the fixing component.

16. The recording device according to claim 15, wherein the fixing component of the recording device adjusts fixing conditions to correspond to types of recording media identified by the recording media identifier.

17. The recording device according to claim 13, further comprising a fixing component which fixes, onto the recording medium, an image recorded by the recording component, wherein the measuring component measures the speckle after fixing of the recorded image onto the recording medium has been carried out by the fixing component.

18. The recording device according to claim 13, further comprising a conveyor component, which conveys the recording media, and wherein the measuring component measures a speckle while the recording medium is not being conveyed by the conveyor component.

19. The recording device according to claim 13, further comprising a conveyor component, which conveys the recording media, and wherein the measuring component measures a speckle while the recording medium is being conveyed by the conveyor component.

* * * * *